US006129795A

United States Patent [19]

Lehockey et al.

[11] Patent Number: 6,129,795

[45] Date of Patent: Oct. 10, 2000

[54] METALLURGICAL METHOD FOR PROCESSING NICKEL- AND IRON-BASED SUPERALLOYS

[75] Inventors: Edward M. Lehockey, Oakville; Gino Palumbo, Etobicoke; Peter Keng-Yu Lin, North York; David L. Limoges, Etobicoke, all of Canada

[73] Assignee: Integran Technologies Inc., Toronto, Canada

[21] Appl. No.: 09/127,958

[22] Filed: Aug. 3, 1998

Related U.S. Application Data

[60] Provisional application No. 60/054,707, Aug. 4, 1997.

[51] Int. Cl.[7] ..... C21D 8/00; C22F 1/10

[52] U.S. Cl. ..... 148/608; 148/611; 148/624; 148/677

[58] Field of Search ..... 148/608, 611, 148/624, 677

[56] References Cited

U.S. PATENT DOCUMENTS 3,639,179 2/1972 Reichman et al. ..... 148/677

5,702,543 12/1997 Palumbo ..... 148/677

OTHER PUBLICATIONS

Palumbo, G., et al., "Grain Boundaries With Special Properties," *Materials Interfaces*, Chapman & Hall, London, 1992, pp. 190–211.

*Primary Examiner*—George Wyszomierski
*Attorney, Agent, or Firm*—Ridout & Maybee

[57] ABSTRACT

A method is provided for improving the microstructure of nickel and iron-based precipitation strengthened superalloys used in high temperature applications by increasing the frequency of "special", low-Σ CSL grain boundaries to levels in excess of 50%. Processing entails applying specific thermomechanical processing sequences to precipitation hardenable alloys comprising a series of cold deformation and recrystallization-annealing steps performed within specific limits of deformation, temperature, and annealing time. Materials produced by this process exhibit significantly improved resistance to high temperature degradation (eg. creep, hot corrosion, etc.), enhanced weldability, and high cycle fatigue resistance.

4 Claims, 11 Drawing Sheets

Conventional

GBE

Conventional

GBE

1. Microplasma (Edge)
2. Microplasma (Bead-on-Plate)
3. TIG, high heat input
4. TIG, low heat input (Chilled)

Conventional

GBE

METALLURGICAL METHOD FOR PROCESSING NICKEL- AND IRON-BASED SUPERALLOYS

RELATED APPLICATION

This application replaces Provisional Patent Application Ser. No. 60/054,707 from which it derives the benefit of a filing date of Aug. 4, 1997.

FIELD OF THE INVENTION

The present invention relates to methods for processing precipitation hardenable Ni- and Fe-based (FCC) superalloys.

BACKGROUND OF THE INVENTION

Superalloys are traditionally subdivided according to whether strength is obtained from solution hardening or the precipitation of secondary phases. The present invention is directed to Ni or Fe-based austenitic (FCC) precipitation hardened alloys, specifically, alloys in which precipitation hardening is derived from (1) the presence of carbide forming agents such as: Nb, Cr, Co, Mo, W, Ta, and V, as well as (2) intermetallic compounds formed by Al and Ti at concentrations typically ranging between 1% and 5%. With the exception of Cr, carbide formers usually exist in concentrations of less than 5%.

Examples of the nominal compositions of selected commercially significant Ni- and Fe-based, precipitation hardened, superalloys are provided in Table 1. (It should be noted that the scope of alloy compositions to which the processes described herein applies includes, but is not necessarily limited to those listed in Table 1). All footnoted references herein are to be taken as incorporated by reference in the specification for their respective disclosures and teachings concerning superalloys and background metallurgical science.

TABLE 1

| Alloy | Composition in wt % | | | | | | | |
|---|---|---|---|---|---|---|---|---|
| Designation | Ni | Fe | Cr | Co | Al | Ti | Mo | Other |
| Alloy V-57 | 26 | bal | 15 | — | 0.25 | 3 | 1.25 | 0.3 V |
| Alloy 738 | bal | — | 16 | — | 3.5 | 3.5 | 1.8 | 2.6 W, 0.9 Nb |
| Alloy 100 | bal | — | 10 | 15 | 5.5 | 4.7 | 3 | 0.95 V |
| Alloy 939 | bal | — | 23 | 19 | 1.9 | 3.7 | — | 2 W, 1 Nb, 1.4 Ta |

The alloying additions to the Ni and Fe-based superalloys of Table 1, whether in solid solution or precipitate form, allow the tensile strength of these materials to be maintained at temperatures in excess of 80% of the melting point[i]. As a result, these materials have become widely used in high temperature applications such as: nuclear reactors, petrochemical equipment, submarines and rocket/jet and gas turbine engines[1-4].

In many of the industrial applications cited above, these materials are required to reliably sustain temperatures and stresses in excess of 1000° C. and 400 MPa, respectively for periods of up to 10,000 hours[2]. Further, stress and temperature extremes are often accompanied by exposure to sulphate and other corrosive media. Under these conditions, reliability, and service life of superalloy components is contingent upon resistance to creep, intergranular corrosion, and fatigue[1-3]. Sustained temperatures of between 800° C. and 1000° C. (in the presence of sulfur, which diffuses along grain boundaries forming $Ni_3S_2$, CrS or $Cr_2S_3$, commonly referred to as "spiking"), render these alloys susceptible to intergranular degradation by "hot" corrosion, fatigue, and creep. "Hot corrosion" and sulfide "spiking" at intergranular cites ultimately results in a loss of tensile, fatigue, and impact strength[1-4].

Moreover, Ni-and Fe-based precipitation hardened superalloys such as: Alloy V-57, Alloy 738, and Alloy 100 generally exhibit poor weldability, limiting their use in applications where complex geometries are constructed by joining of individual components. For example, this has been the main limitation for using higher temperature precipitation-strengthened alloy formulations for combustor-can components[2]. Weldability correlates directly with the Al and Ti content in the alloy, as illustrated in FIG. 1[5]. Gamma prime (γ') phases formed by these constituents (i.e. $Ni_3(Al,Ti)$) which are responsible for high temperature strength, precipitate along grain boundaries in the weld heat-affected-zones resulting in hot cracking (during welding) and Post-Weld Heat Treatment (PWHT) cracking.

Although significant improvements have been made in minimizing these intergranular effects by alloying additions to control the content, distribution, and growth (Oswald ripening) of intermetallic γ' ($NiAl_3$) and carbide (MC, $M_{23}C_6$ MKC) phases[6,7], thermal conductivity and phase stability place practical limits on alloying as a means of further improving corrosion, creep, fatigue, and strength performance. Single crystal, directionally solidified, ceramic, and diffusion barrier overlay components such as $NiAl_3$ or MCrAlY offer superior fatigue, corrosion, and creep resistance than conventional superalloys, largely at the expense of cost, manufacturing throughput, and often reliability[2,4,7]. Fracture toughness and critical defect sizes in competing materials such as ceramics (eg. silicon nitride) are approximately two orders of magnitude smaller than for nickel-based superalloys at typical operating stresses[2], significantly limiting reliability of these high temperature materials[2].

It has been shown that grain boundaries having misorientations described on the basis of the Coincident Site Lattice Model (CSL)[8] of interface structure as lying within $\Delta\theta$ of $\Sigma$ where $\Sigma \leqq 29$ and $\Delta\theta \leqq 15\Sigma^{1/2}$ [9] are highly resistant to intergranular degradation processes such as: corrosion[10], cracking[11], and grain boundary sliding/cavitation[12-14]. This arises from the reduced free volume and superior fit between the abutting lattices that form boundaries between adjacent grains in the microstructure. The present applicants have previously disclosed that the frequency of these degradation-resistance grain boundaries can be enhanced in the microstructure of various FCC materials including lead[15,16] and austenitic stainless alloys[17] from 10%–20% to levels in excess of 50% to 60% resulting in significant improvements in creep, intergranular corrosion, and cracking resistance.

Evidence exists to suggest that high fractions of "special" grain boundaries can stabilize passive oxide layers, while significantly reducing localized grain boundary attack[18]. Solution hardened Alloys 600 and 800 processed such that 80% of the grain boundaries in the microstructure are "special" have been previously demonstrated by the present applicants to be virtually immune to intergranular corrosion[10]. In addition, we have recently demonstrated that microstructures of pure nickel having "special" grain boundary fractions in excess of 50% exhibit improvements of 15 fold and 5 fold in steady-state creep rate and primary creep strain, respectively[19]. Furthermore, the reduced propensity for solute segregation, cracking, and cavitation, offers the potential for minimizing alloy susceptibility to crack nucleation and propagation originating from low-cycle fatigue and Post Weld Heat Treatment (PWHT) cracking[2,3]. In contrast to traditional alloy development approaches wherein treatments applied to benefit one characteristic often degrade other performance aspects, optimizing grain boundary structure in these superalloys provides for simultaneously improving creep, corrosion, fatigue, and weldability performance. Furthermore, since altering grain boundary structure does not necessarily involve variations in alloy chemistry, improvements in performance cannot detrimentally affect thermal conductivity and phase stability.

SUMMARY OF THE INVENTION

In the present invention, a thermomechanical process is disclosed for increasing the frequency of low-Σ CSL grain boundaries in the microstructure of Ni or Fe superalloys such as Alloy 625 (Ni-based), V-57 (Fe-based), and Alloy 738 (Ni-based). These materials are processed from cast ingots or wrought starting stock by a plurality of specific repetitive cycles of deformation (by rolling, pressing, extruding, stamping, drawing, forging, etc) and subsequent recrystallization-annealing treatments at temperatures and times which depend on alloy composition. This processing protocol imparts significant improvements in intergranular/hot corrosion, creep, and fatigue resistance with commensurate improvements in component reliability and operating life.

BRIEF DESCRIPTION OF THE TABLES AND DRAWINGS

Table 1 shows typical known compositions of Ni and Fe based, austenitic, precipitation-hardenable superalloys for which the method of the present invention can be used to elevate the special grain boundary frequency to improve corrosion, creep, and weldability performance.

Table 2 gives the optimum thermomechanical processing ranges of deformation, recrystallization temperatures, annealing times, and number of multi-recrystallization steps for increasing the frequency of special grain boundaries by the method taught in the present application. [Note: "S" designates Solution Treating conditions; "P" designates the Precipitation Hardening Conditions]

Table 3 summarizes the population of special grain boundaries present in three (3) commercial superalloys after re-processing according to the preferred embodiments of the present disclosure versus that in the commercially available, conventionally processed alloy condition. The Grain Boundary Character Distributions shown were determined on representative metallographic sections of materials using an automated electron backscattering (EPSB) techniques in a conventional scanning electron microscope. Note: GBE Refers to processing by method disclosed in the present invention.

FIG. 1 illustrates graphically the dependence of superalloy weldability on concentration of titanium and aluminum in the material.

FIG. 2 is a strain/time graph showing the reduction in primary creep strain and steady-state creep rate resulting from increasing the frequency of special boundaries in the microstructure (Table 1) of Alloy V-57 by the metallurgical process of the present invention. Stress and temperatures selected to be in a regime where creep arises predominantly from grain boundary sliding Note: GBE (Grain Boundary Engineered) refers here and throughout this specification to processing by methods according to the present invention.

FIG. 3 is a bar graph illustrating the improvement in fatigue resistance of Alloys 738 and V-57 accrued from processing according to the description of the present invention. Cycles to failure were measured under room temperature conditions using maximum stress amplitudes and stress ratios (ie. $\sigma_{max}/\sigma_{min}$ indicated for the respective alloys using a nominal loading frequency of 17 Hz.

FIG. 4 shows graphically the variation in susceptibility to intergranular corrosion (weight loss) as a function of increasing special grain boundary frequency in Fe-based V57 resulting from processing according to the method taught in the present application measured according to ASTM G28 using a solution of boiling ferric sulphate.

FIG. 5 is a bar graph comparing the depth of intergranular corrosion penetration observed in Low Temperature Hot Corrosion (LTHC) tests of Alloy 738 alloys between conventionally processed material (A/R) and corresponding alloys processed according to the method described in the present invention. Measurements were obtained from cross sectional micrographs after 100 hours in $NaSO_4$:$SO_2$ at 500° C.

FIG. 6(*a*) is a reproduction of two photomicrographs comparing the extent of sulphide spiking in conventional alloy 738 versus that processed according to the present invention having a frequency of special boundaries indicated in Table 3 after 375 hours at 900° C. in $NaSO_4$:$SO_{2(g)}$.

FIG. 6(*b*) is a bar graph showing the effect of processing according to the present invention on the High Temperature Hot Corrosion (HTHC) resistance of Alloy 738. Intergranular penetration depth, depth of pitting and sulphide spiking measured in the alloy processed according to the present invention and the conventional Alloy 738 alloy are shown as a function of time in $NaSO_4$ at 900° C.

FIG. 7 schematically shows the sample geometry and weld configuration used to evaluate the relative weldability of conventional Alloys 738 and V-57 with corresponding materials processed according to the method of the present invention using Microplasma Arc and TIG welding techniques.

FIG. 9(*b*) is a bar graph comparing the average density and penetration depth of Post-Weld Heat Treatment (PWHT) cracks observed in the Heat Affected Zones (HAZ) of conventional Alloy V-57 versus that found in the corresponding alloy processed according to the method of the present invention. (Note: TIG welds were of "edge type" as indicated in FIG. 7).

DETAILED DESCRIPTION OF THE INVENTION

Figure 1:
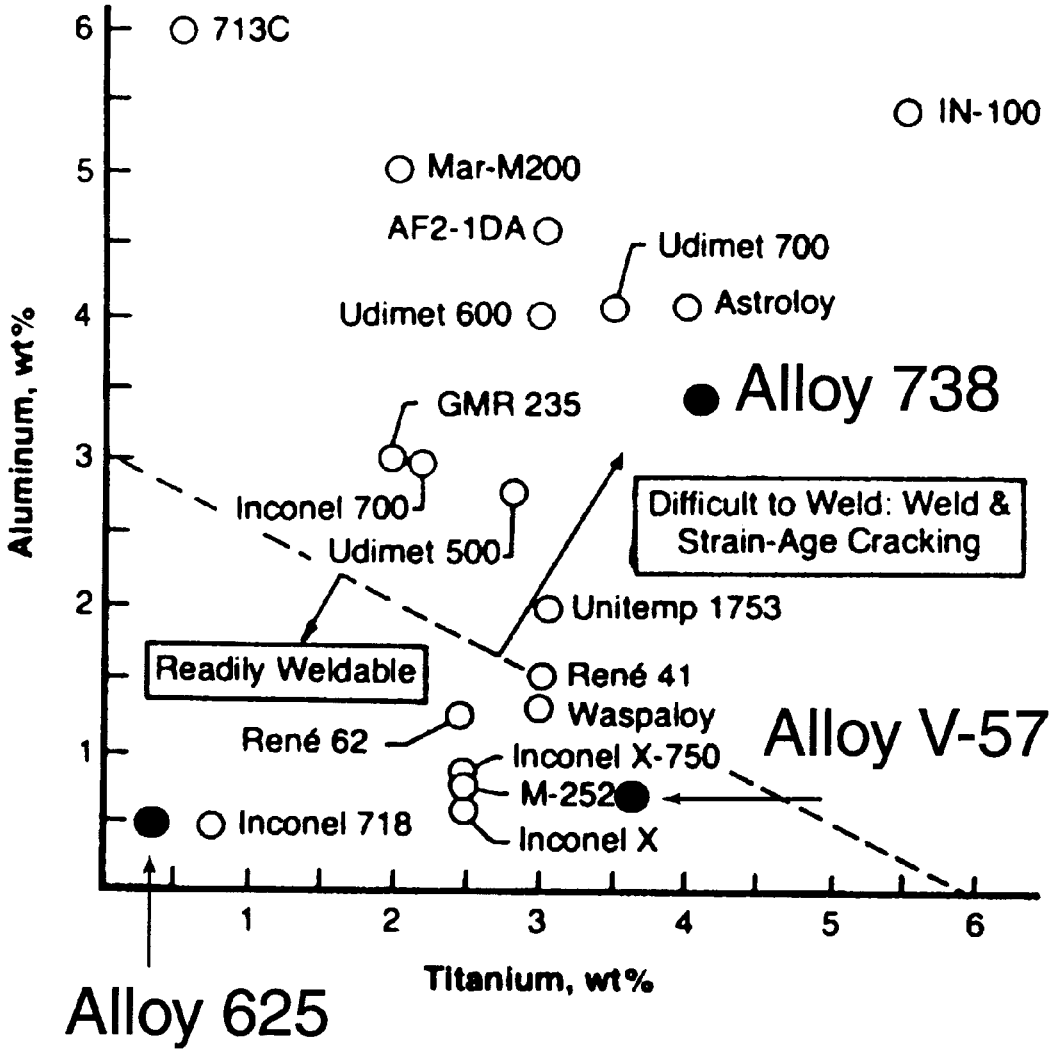

The present invention embodies a method for processing nickel and Fe-based superalloys to contain a minimum of 50% special grain boundaries as described crystallographically as lying within $\Delta\theta$ of $\Sigma$ where $\Sigma \leqq 29$ and $\Delta\theta \leqq 15\Sigma^{-1/2}$, in the context of the Coincident Site Lattice framework[8]. Microstructures having special boundary frequencies in excess of 50% are generated by a processes of selective and repetitive recrystallization, whereby cast or wrought starting stock materials are deformed by any of several means (eg. rolling, pressing, stamping, extruding, drawing, swaging, etc) and heat treated above the recrystallization temperature. The exact annealing temperature and time is governed by the alloy composition. The process requires that each deformation-annealing step be repeated a plurality of times such that during each cycle, random or general boundaries in the microstructure are preferentially and selectively replaced by crystallographically "special" boundaries arising on the basis of energetic and geometric constraints which accompany recrystallization and subsequent grain growth.

Selected alloys encompassed by the present invention having high $Ni_3Al$ contents (eg. Alloys 738, 939, 100, etc) require a pre-treatment step consisting of a 10%–20% deformation followed by a lengthy anneal in the temperature range between 1100° C.–1300° C. for periods between 1 and 8 hours. This pre-treatment step solutionizes the alloy and coarsens the carbide and γ' precipitate distributions allowing sufficient grain boundary mobility for the formation of "special" grain boundaries during the subsequent multi-recrystallization steps.

Special, low-Σ CSL grain boundaries are formed during several recrystallization steps; each step consisting of a deformation in the range between 10% and 20% with a subsequent heat treatment between 900° C. and 1300° C. for periods of 3 to 10 minutes. Times are adjusted such that the grain size in the final product does not exceed 30 μm to 40 μm.

Precipitation hardenable alloys (either Ni- or Fe-based) require an additional deformation annealing step whereby the alloy is subjected to a deformation of 5% and precipitation hardened by annealing at a temperature below the solvus line in the phase diagram (700° C.–900° C.) for periods of 12 hrs to 16 hrs. This precipitation treatment is necessary to reverse the solutionizing effect of the multiple recrystallization treatments and restore the original alloy strength. The light deformation accompanying the precipitation treatment inhibits formation of precipitation free zones (PFZs) around selected grain boundaries (eg. twins (Σ3)) in the microstructure which can undermine the intended improvements in creep, corrosion, and fatigue resistance accrued from processing according to the embodiment of the present invention.

A summary of the preferred processing regimen applicable for each of the alloys cited in Table 1 are provided in Table 2, below.

TABLE 2

| Alloy | (S)olutionizing or (P)recipitation Treatment[1] | Deformation (%) | Annealing Temperature (° C.) | Anneal Time (min) | Number of Cycles | Final Grain Size (μm) |
|---|---|---|---|---|---|---|
| 738 | S: 20% + 1200° C./1 hr<br>P: 10% + 875° C./16 hrs | 10–20% | 1175 min. | 5–10 | 3–6 | 40 |
| V-57 | S: n/a<br>P: 5% + 732° C./16 hrs | 10% | 1000 | 3–5 | 2–3 | 30 |
| 100 | S: 20% + 1250° C./4 hrs<br>P: 10% + 700° C./16 hrs | 10%–20% | 1100–1250 | 3–10 | 3 min | <30 |
| 939 | S: 20% + 1250° C./8 hrs<br>P: 10% + 700° C./16 hrs | | | | | |

[1]Ranges of deformation, temperature, annealing time are given for which microstructure features (ie. grain size and special boundaries frequency) are consistent with those cited in Section 4.

Table 3 compares the Grain Boundary Character Distribution (GBCD) for (1) Alloy 939, (2) Alloy V-57, and (3) Alloy 738 in both the conventionally processed condition versus that obtained by reprocessing according to the preferred embodiments of the present invention. Processing as described herein significantly elevates the frequency of twins (Σ3) and often their crystallographically related variants (ie. $\Sigma 3^n$=1,2,3). Overall special boundary fractions (ie. $1 \leqq \Sigma \leqq 3$) in the conventional material being between 20% and 34% are enhanced to levels of 50% to ~60% by the protocol described in the present application.

TABLE 3

| Σ | Boundary Frequency (%) (GBE Optimized Microstructures) | | | | | |
|---|---|---|---|---|---|---|
| | Alloy 939 | | Alloy V-57 | | Alloy 738LC | |
| | Conventional | GBE | Conventional | GBE | Conventional | GBE |
| | 1.2 | 2.5 | | | | |
| | 9.3 | 48.6 | | | | |
| | 0.6 | 0.4 | | | | |
| | 0.7 | 0.6 | | | | |
| | 4.4 | 5.3 | | | | |
| | 2.5 | 0.9 | | | | |
| | 0.9 | 0.6 | | | | |
| | 0.2 | 0.5 | | | | |
| | 0.4 | 0.4 | | | | |
| | 1.5 | 0.5 | | | | |
| | 0.2 | 0.1 | | | | |
| | 0.1 | 0.1 | | | | |
| | 0.1 | 0.2 | | | | |
| | 2.3 | 0.5 | | | | |
| >29[a] | 1.2<br>74.5 | 2.0<br>49.3 | 71.8 | 37.7 | 79.6 | 50.0 |
| 1 < Σ <29[b] | 24.4 | 50.7 | 21.5 | 59.7 | 9.6 | 50 |

[a]Random Grain Boundaries
[b]Special Grain Boundaries
Note: Thermomechanical processing conditions used to obtain the grain boundary character distributions in material processed according to the present invention (designated "GBE") are those specified for the corresponding alloy in Table 2.

EXAMPLE #1

Creep Resistance

As received samples of alloy V-57 were given a total of 3 deformation cycles each consisting of a 10% reduction followed by a 3 minute anneal at 1000° C. Processed material was subsequently precipitation hardened using a 5% deformation followed by an anneal at 732° C. for 16 hours as described in Table 2. Conventional Alloy V-57 together with that processed by the present invention were creep tested according to ASTM E139[27] at a temperature of 800° C. and stress of 82 MPa which promotes grain boundary sliding[28]. A sufficient test period was selected to establish the primary creep strain and steady-state creep rate. The resulting effect of altering the grain boundary structure on the creep resistance of Alloy V-57 is presented in FIG. 1. Processing according to the method disclosed in the present invention reduces pprimary creep strain by a factor of 5 to 10, while steady state creep rate is reduced by a factor of 15.

EXAMPLE #2

Fatigue Resistance

Figure 2:
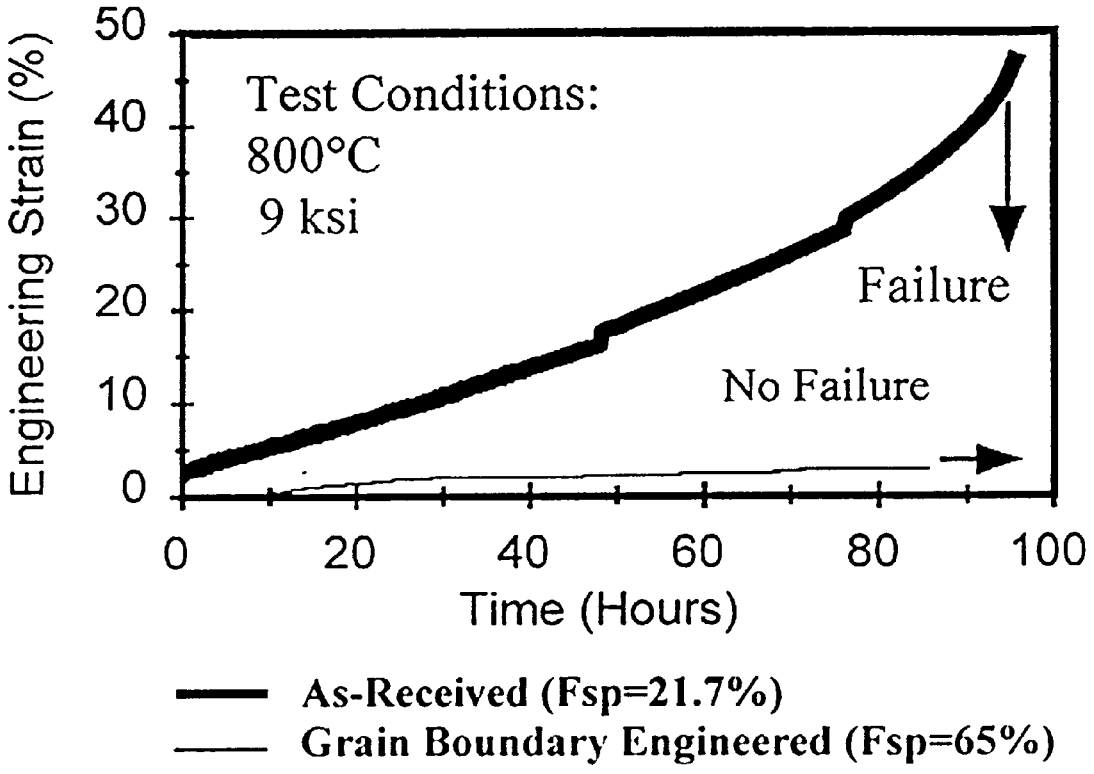
Figure 3:
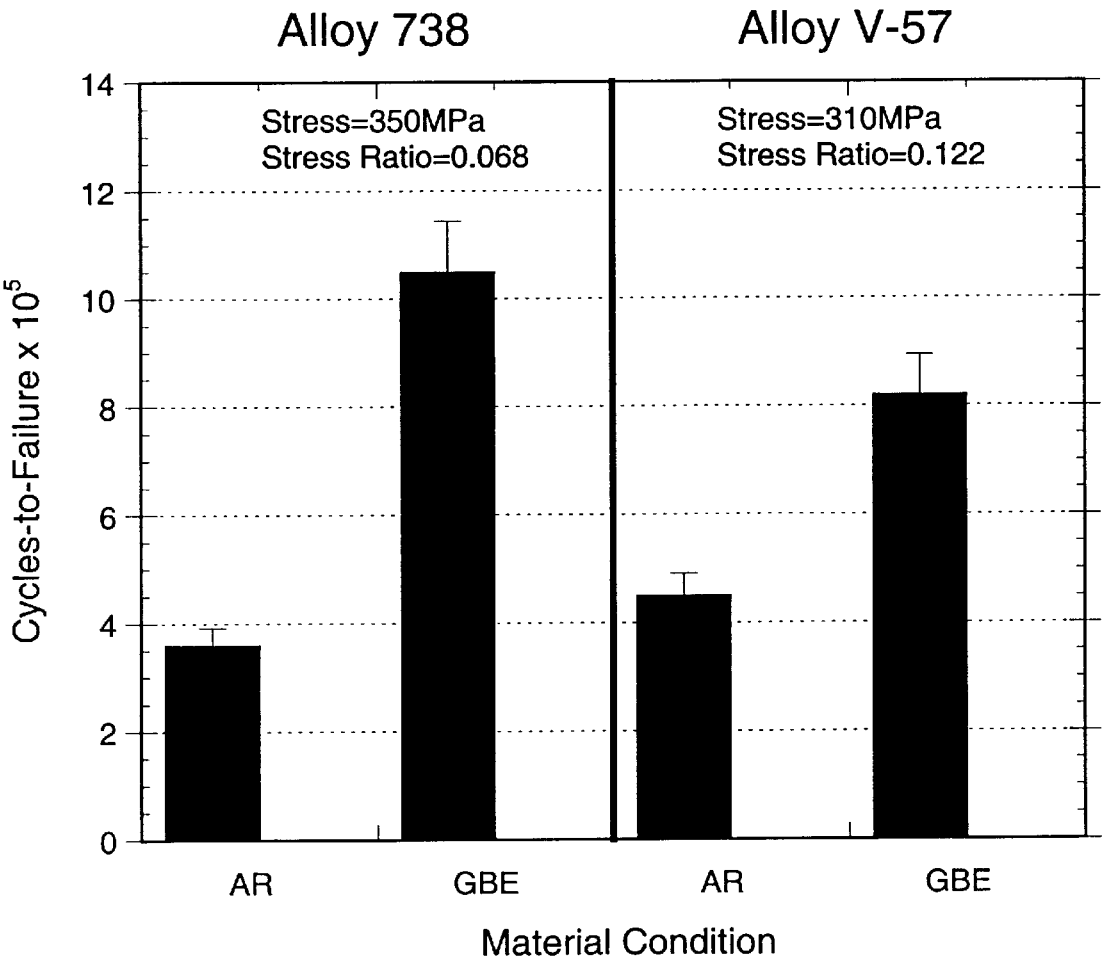

The effect of grain boundary structure on the fatigue resistance of Alloys 738 and V-57 superalloys was measured according to ASTM E 466[29,30]. As received samples of each material were processed according to the preferred embodiment of the present invention as indicated in Table 3 so as to increase the frequency of special grain boundaries from levels in the conventional material to optimum levels of 50% or greater as depicted in Table 1. Dumbbell samples were sectioned from both the conventional material and those processed according to the present application having a gauge length of 16 mm and cross-section of 4.0 mm(W)× 2.3 mm(T). Gauge length surfaces on each sample were mechanically polished to a 1 μm finish, so as to minimize variances due to surface asperities. The average number of cycles-to-failure was measured at room temperature, in uniaxial tension, using a frequency of 17 Hz based on 10 replicate measurements. As demonstrated in FIG. 2, optimizing the frequency of "special" grain boundaries in Alloys V-57 and 738 (ref Table 3) by the thermomechanical process of the present invention increases the mean cycles to failure by 2 and 5 fold, respectively for the two materials. Moreover, the standard deviation in the mean number of cycles to failure expressed as a percentage of the mean among replicates of material processed in accordance with the present disclosure is half that measured in the conventional commercial alloy; demonstrating the potential for improved fatigue resistance, and superior predictability/reliability of alloys processed according to the method described herein.

EXAMPLE #3

Intergranular Corrosion Resistance

Susceptibility of Alloy V-57 to intergranular corrosion was evaluated as prescribed by ASTM G-28[25]. Three replicate 1 $cm^2$ samples of each of the conventional alloy and that processed according to the preferred embodiment of the present invention (as summarized in Table 3) were sensitized using a 750° C. anneal for 3 hours. Specimens were weighed to the nearest milligram and immersed in a 600 ml solution of boiling ferric sulfate (31.25 g/l)-50 pct sulfuric acid 120 hours. Samples were subsequently cleaned in an acetone-methanol solution and re-weighed to establish mass loss upon which corrosion rates were calculated (in mils per year). Unfortunately, test procedures outlined in ASTM G-28 are unsuitable for accurately evaluating corrosion characteristics of Alloy 738[23-25] due to its composition and the particularly aggressive operating conditions to which this alloy is exposed. Accordingly, Alloy 738 was tested using industry-standard High Temperature (Type I) and Low Temperature (Type II) "Hot Corrosion" tests that more appropriately reflect environmental conditions encountered in service[26,27].

Ten coupons of the conventional alloy Alloy 738 and the corresponding alloy processed by the preferred embodiment of the present invention (according to Table 3) having surface areas ranging between 300 $mm^2$ and 500 $mm^2$ were cleaned ultrasonically in water and acetone, with a final methanol rinse and allowed to dry in air. After weighing to the nearest one-tenth of a milligram, specimens were preheated to a temperature of 300° C. and sprayed with a sufficient quantity of 60:40 (mole pct) $Na2SO_4$:$MgSO_4$ salt solution to fully cover the surface and produce an average mass gain of between 1.5 and 2.0 $mg/cm^2$. Test materials were then placed in a tube furnace wherein a mixture of 2000 ml/min of air and 5 mi/min of $SO_2$ was continuously circulated at temperatures of 500° C. During the 100-hour test period, samples were removed at 25-hour intervals and re-weighed to establish mass loss. Following each sampling interval, the surface coating of salt was refreshed according to the previously described procedure.

Type I, High Temperature Hot Corrosion (HTHC) tests were performed using the LTHC test procedure above with a furnace temperature of 900° C., over a total test duration of 500 hours. Coupons removed at 100 hour sampling intervals were cross-sectioned, metallographically prepared, and examined by optical microscopy to determine the depth of pitting, intergranular attack, and sulfide incursion along the grain boundaries.

Figure 4:
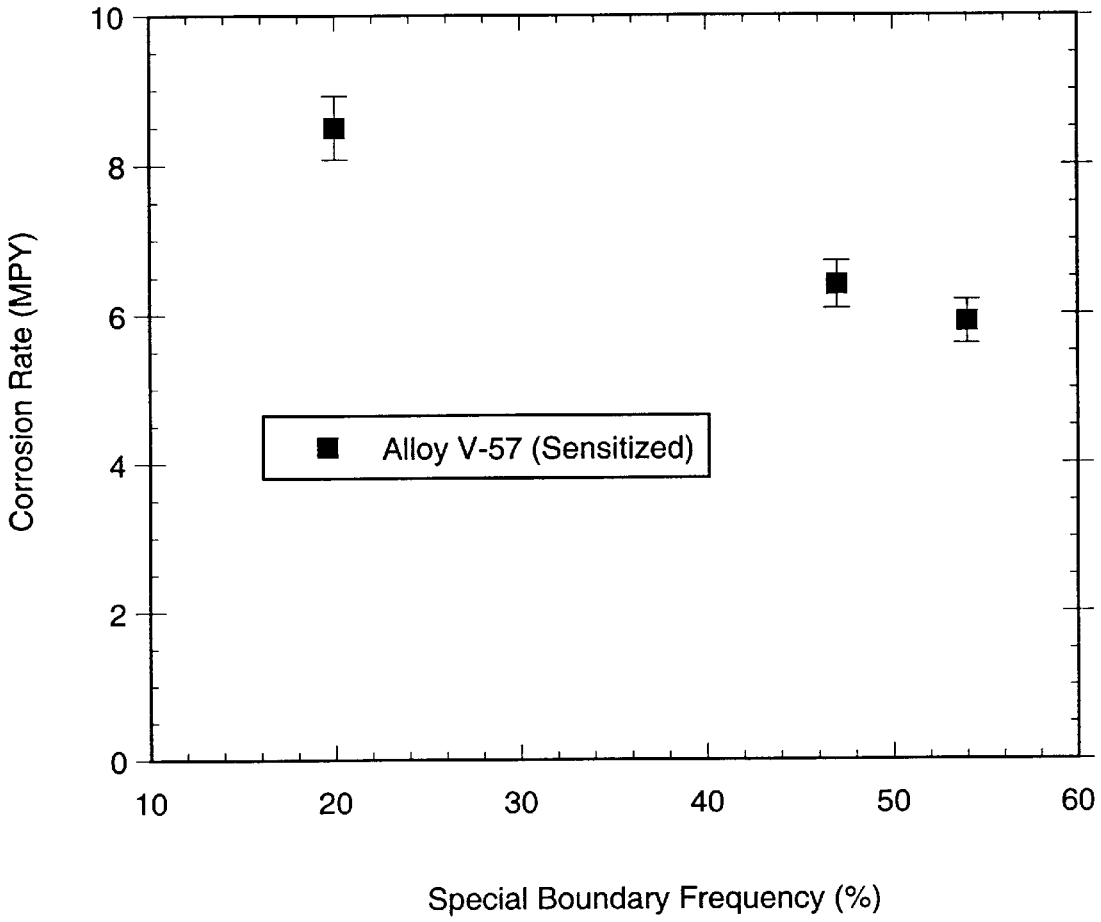
Figure 5:
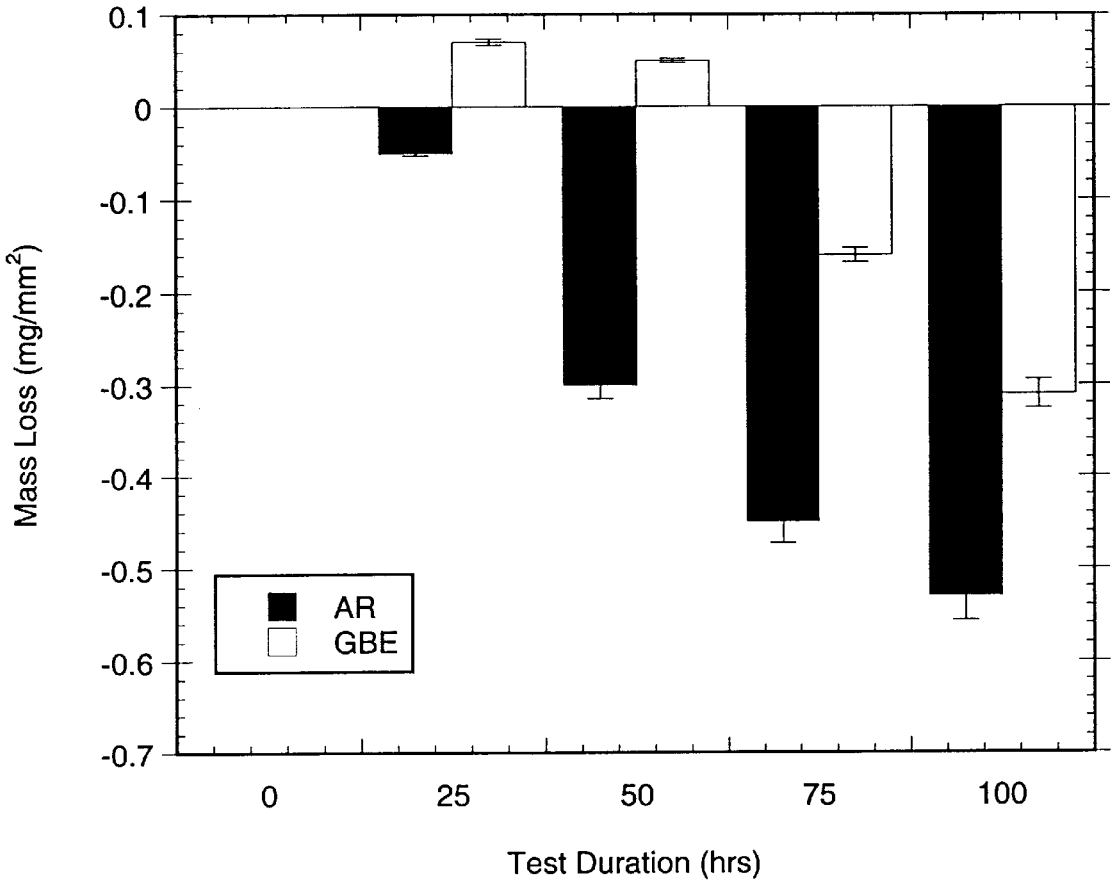

The effect of increasing the "special" grain boundary frequency by the method described in the present invention on the susceptibility of Alloy V-57 to intergranular corrosion is presented in FIG. 4. Microstructures containing "special" boundary fractions exceeding 50% exhibit reductions of 40% to 60% in corrosion rate (in mpy). Reductions of similar magnitude in low temperature (Type II) "hot" corrosion are evident for Alloy 738, as demonstrated by differences in mass loss between the GBE-processed and "As Received" material in FIG. 5. Moreover, the GBE alloy experiences a significant initial gain in mass, that is not observed in the conventional "as-received" material. This is believed to reflect the formation of a thicker, more protective, adherent oxide layer than is present on the corresponding conventional alloy.

Figure 6A:
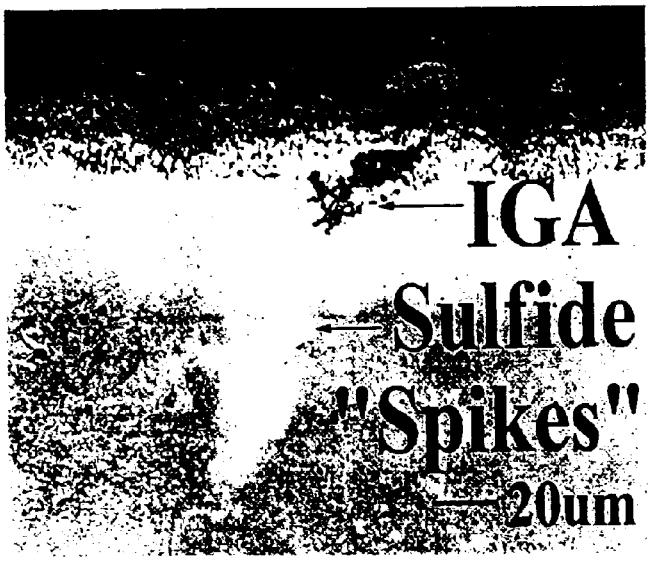
Figure 6A:
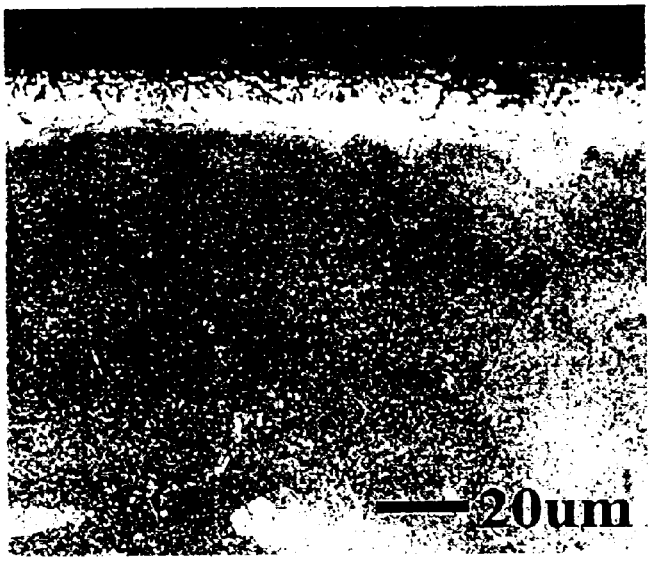
Figure 6B:
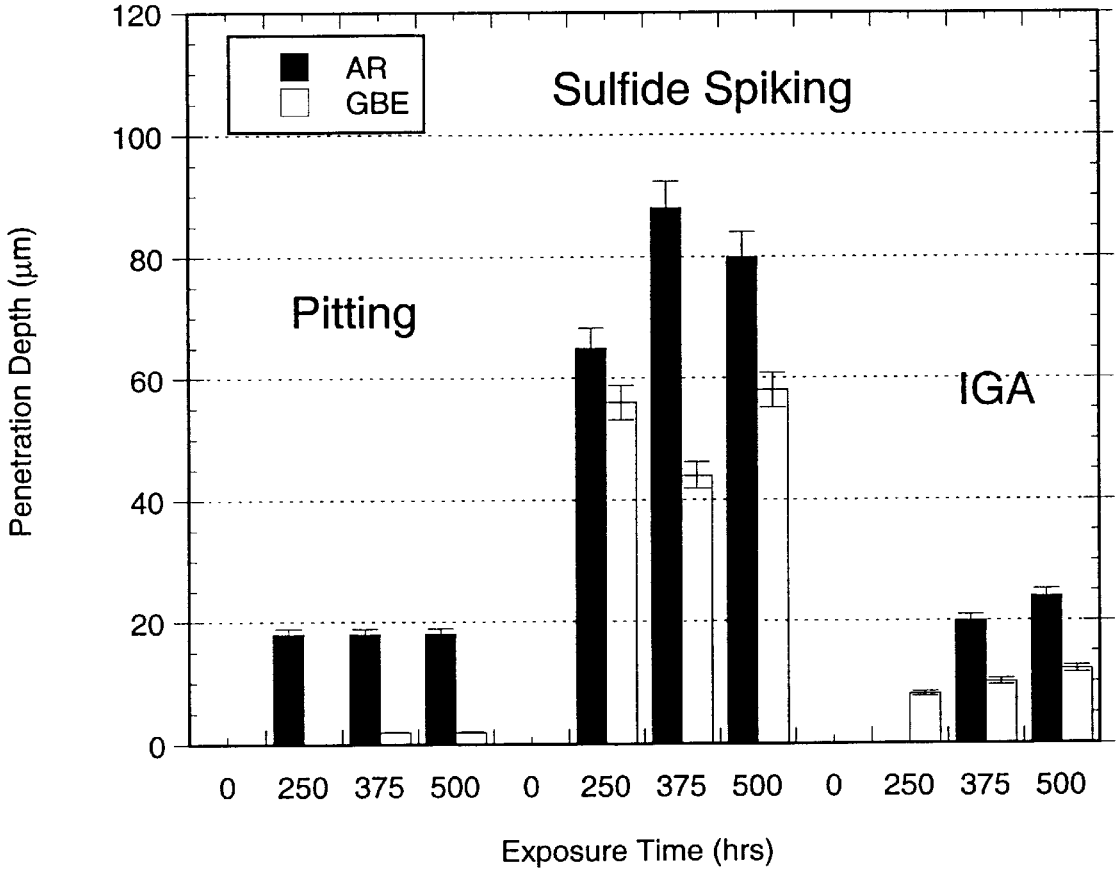

Differences in the extent of intergranular penetration observed in Alloy 738 after high temperature (Type I) "hot" corrosion tests between the "As-Received" and GBE alloys are compared in FIG. 6(*a*). While significant sulfide incursion is noted along the grain boundaries of the conventional (A/R) material, microstructures containing 50% special grain boundaries undergo relatively uniform attack with no evidence of sulfide "spiking". Corresponding values for the average depth of pitting, sulfide, and intergranular attack (IGA) between the conventional and grain boundary engineered material after 250 hours of exposure are summarized in FIG. 6(*b*). Optimizing grain boundary structure in Alloy 73 8 reduces pitting, sulfide "spiking", and intergranular attack (IGA) by 80%, 30%, and 50%, respectively. The above evidence demonstrates the possibility for doubling component service life, while enhancing reliability and reducing maintenance/outage costs, by controlling grain boundary structure in these alloys.

EXAMPLE #4

Superalloy Weldability

Figure 7:
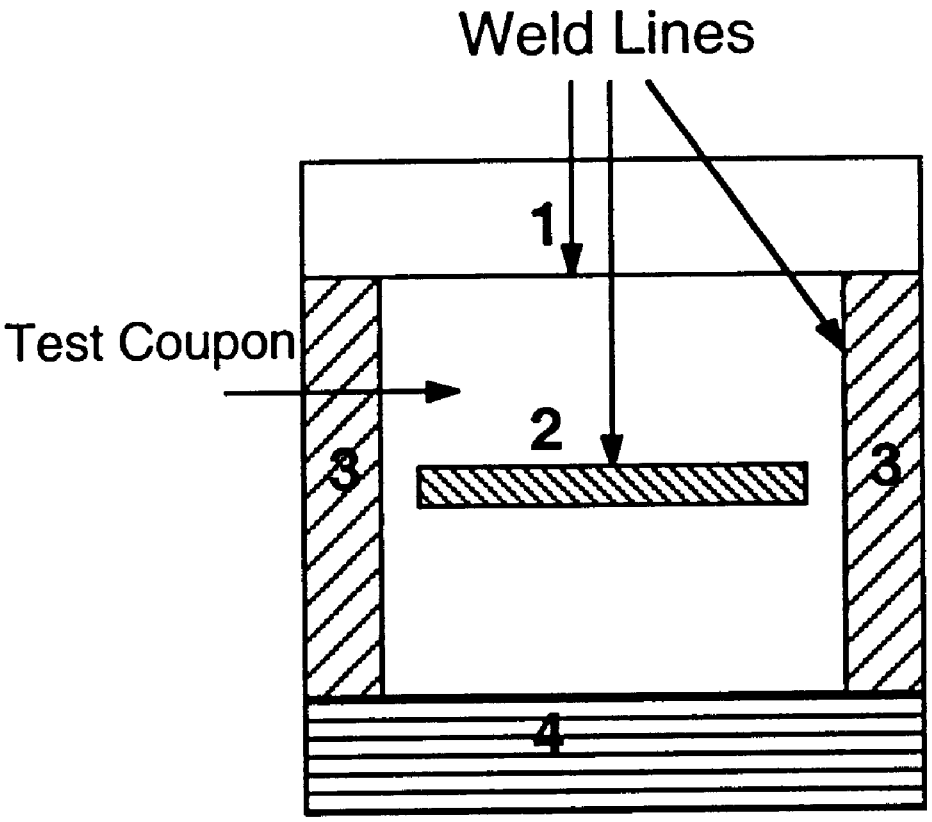

The effect of altering grain boundary structure on the weldability of V-57 and 738 alloys by Microplasma Arc and TIG techniques was evaluated. Twelve coupons of both conventional and GBE-processed material, having nominal dimensions of 5 cm×2.5 cm were electro-discharge machined and cleaned of surface deposits using acetone. Welds were formed along the coupon edges and surface, as illustrated in FIG. 7. Welds on V-57 and 738 substrates were formed using A286 and IN718 filler-wire, respectively. TIG welds were made with parent material exposed to ambient conditions, (designated "hot") as well as "chilled" between copper blocks, in order to vary the severity of the welding environment. Specimens were subsequently annealed under vacuum at 1080° C. for one-half hour and quenched using an argon gas purge. Cracking susceptibility was evaluated based upon: (1) crack depths determined from cross-sectional metallography, as well as (2) the number of crack indications observed per unit of linear weld length determined after applying a die penetrant to the weld surfaces.

Figure 8:
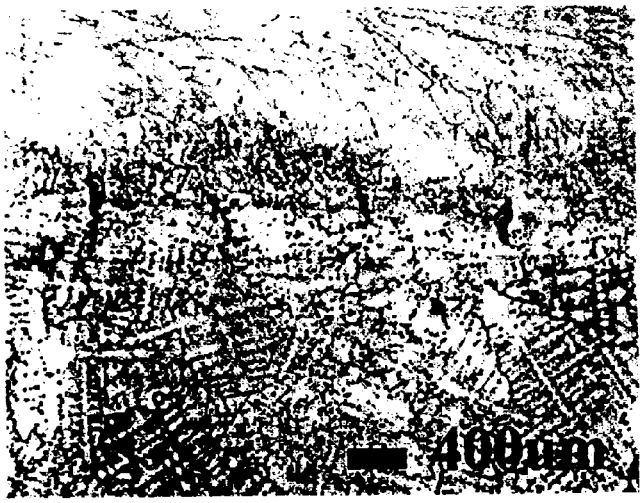
FIG. 8 is a reproduction of two optical micrographs detailing the extent of PWIT cracking observed in typical Microplasma Arc edge welds on Conventional Alloy 738 versus that processed according to the method taught in the present invention.
Figure 8:
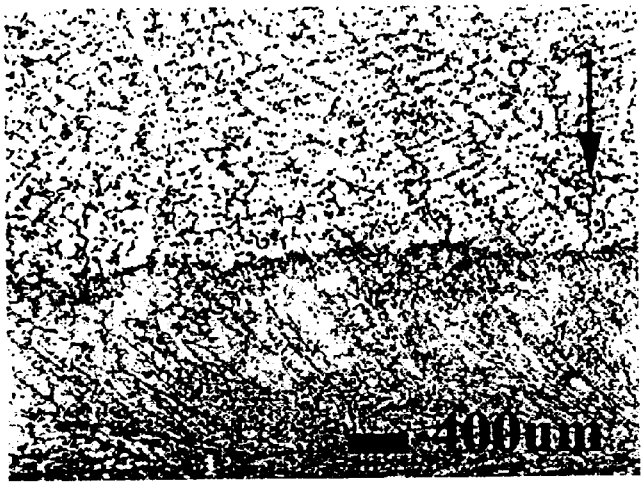

The extent of PWHT cracking observed in Heat Affected Zones (HAZs) of Microplasma arc welds in conventional Alloy 738 (Special Boundary Frequency, $F_{sp}$~10 pct) versus that found in Alloy 738 having a "special" boundary frequency of 50% are compared in FIG. 8. Special grain boundaries significantly reduce susceptibility to cracking. The role of low-Σ CSL grain boundaries in minimizing PWHT cracking is further emphasized in FIG. 9 which compares crack density (in number per cm weld) and/or cumulative depth (per unit length of weld) in the HAZ of edge and bead-on-plate welds formed by Microplasma Arc and TIG procedures. "Special" grain boundaries reduce the crack density in "bead-on-plate" (Mcroplasma Arc ) and (TIG) edge welds produced without cooling of the parent material (hot) by factors of 5 and 1. 5, respectively. No significant differences in post-weld heat treatment crack density were evident in welds formed using more forgiving weld procedures or geometries (e.g., Microplasma-edge) or chilled TIG "edge" welds.

Altering the grain boundary character distribution in favor of low-Σ CSL interfaces reduces the propagation length of cracks in the HAZ of welds by between 3 and 50-fold. Hence, even in those instances where grain boundary structure has no apparent effect on crack density, the presence of "special" grain boundaries significantly reduces the length of crack propagation. According to FIG. 9(*a*) cracking appears less severe in "edge" welds produced on GBE parent material by less forgiving techniques (e.g., TIG (hot)) than that evident in conventional material by more expensive and sophisticated techniques such as Microplasma Arc designed to enhance weldability. It should be noted that cracks formed during TIG welding (in the "chilled" condition) were not of sufficient length in either the conventional or GBE material to accurately establish cumulative crack lengths.

Figure 9A:
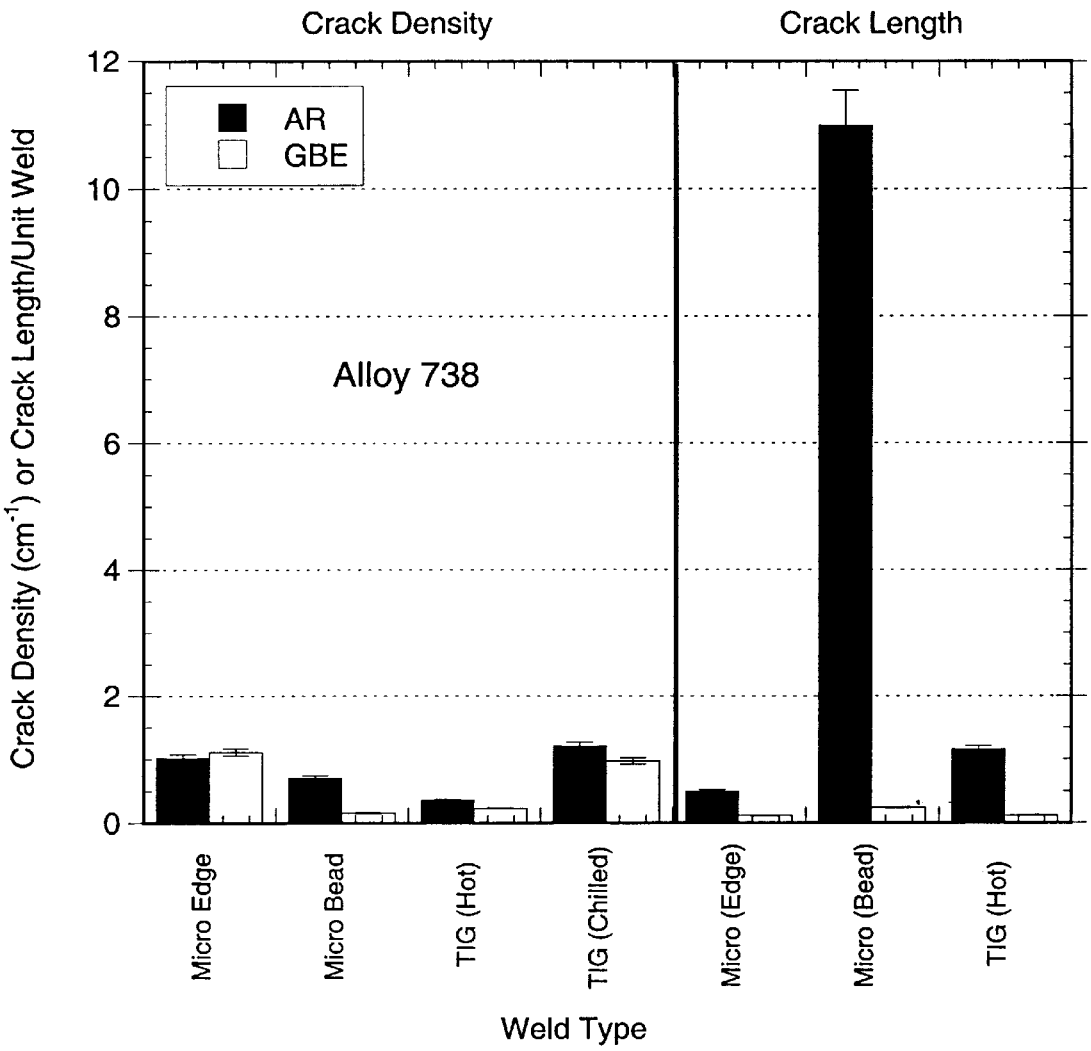
FIG. 9(*a*) is a bar graph comparing the average density and penetration depth of Post-Weld Heat Treatment (PWHT) cracks in the Heat Affected Zones (HAZ) of conventional Alloy 738 versus that found in the corresponding alloy processed according to the method of the present invention. (Note: TIG welds were of "edge type" as indicated in FIG. 7).
Figure 9B:
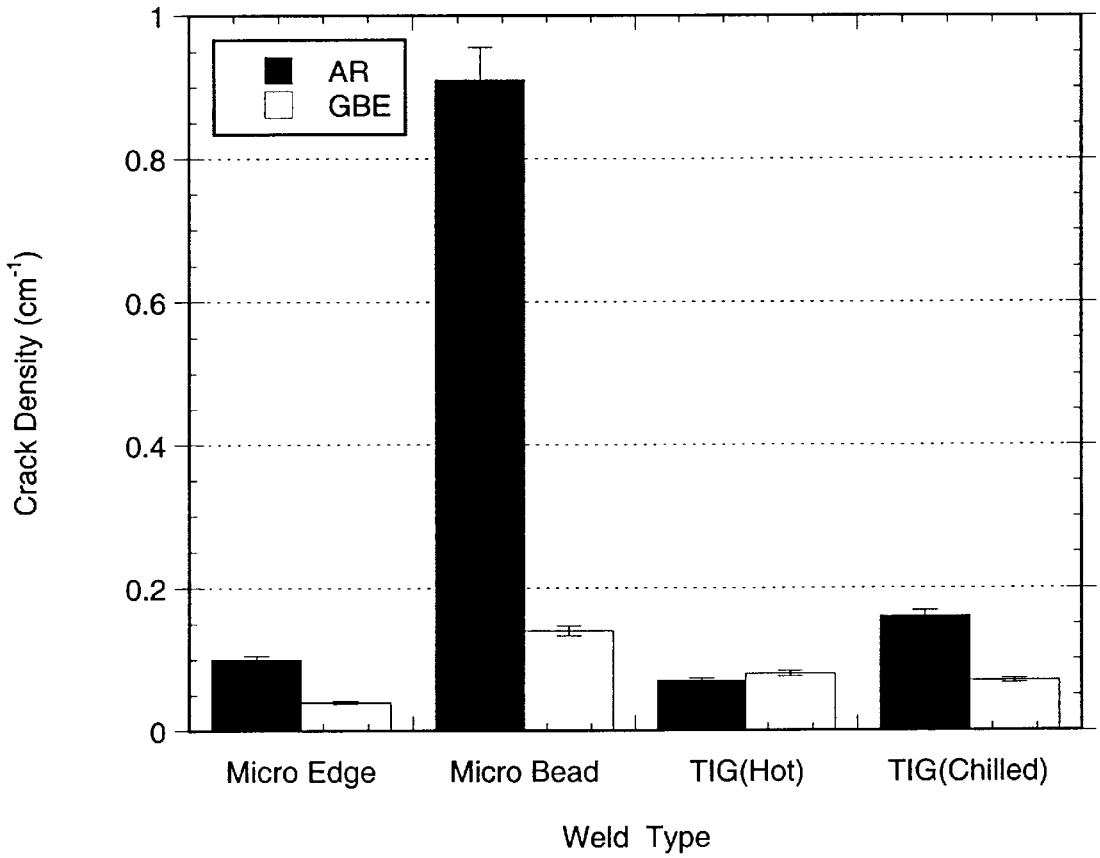

Similar improvements in crack susceptibility were also observed in Fe-based alloys as evidenced by the number density of cracks observed in the welds of conventional versus processed alloy V-57 presented in FIG. 9(*b*). Material processed to contain a high frequency of "special" grain boundaries exhibit a decrease of between 2.5 and 6 fold in post-weld heat treatment crack density over the conventionally processed Alloy V-57. Unfortunately, PWHT cracks were not of sufficient length to practically assess the cumulative/aggregate crack lengths along the weld.

These results underscore the benefit of altering the crystallographic structure of grain boundaries to improve weldability; offering the potential for minimizing the use of expensive, exotic welding techniques or cumbersome and time consuming material processing precautions (e.g., pre-solutionizing alloys, etc) previously necessary to mitigate PWHT cracking in precipitation-hardened superalloys.

We claim:

1. A method for processing a precipitation-hardened austenitic Ni- and Fe-based superalloy to increase the fraction of special low-Σ grain boundaries as defined herein to a level greater than 50%, while maintaining grain sizes in the range of between 5 μm and 50 μm, comprising:

(i) sequential steps of cold deformation of said superalloy starting material, alternating with steps of annealing the material above its recrystallization temperature; and (ii) a final precipitation hardening treatment comprising cold deformation of the superalloy material in the range of from 5% to 10% followed by low-temperature annealing between 700° C and 900° C. for a period of time of up to 16 hours, thereby re-hardening the superalloy material to restore strength.

2. A method according to claim 1, wherein the first step of cold deformation and the immediately subsequent first step of annealing are, respectively, a 10% to 20% cold deformation step and a step of annealing at a temperature in the range of from 1100° C.–1300° C. for a period of from one to eight hours, thereby to effect solutionizing and precipitate coarsening of the superalloy material.

3. A method according to claim 2, wherein said solutionizing and precipitate coarsening of the superalloy is followed by at least three alternations of cold deformation in the range of 10%–20%, with annealing for a period of three to ten minutes at a temperature in the range of from 1000° C. to 1250° C., thereby recrystallizing the material to an average grain size between 5 μm and 50 μm and a fraction of special grain boundary fractions in excess of 50%.

4. A method according to claim 1, claim 2 or claim 3, wherein said precipitation-hardened austenitic Ni- and Fe-based superalloy is selected from the group consisting of Alloy V-57, Alloy 738, Alloy 100 and Alloy 939 as defined herein.

* * * * *